US007699310B2

(12) United States Patent
Shirasaki

(10) Patent No.: US 7,699,310 B2
(45) Date of Patent: Apr. 20, 2010

(54) POST-PROCESSING APPARATUS AND IMAGE FORMING SYSTEM PROVIDED THEREWITH

(75) Inventor: Seiichi Shirasaki, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 126 days.

(21) Appl. No.: 11/984,805

(22) Filed: Nov. 21, 2007

(65) Prior Publication Data

US 2008/0122165 A1 May 29, 2008

(30) Foreign Application Priority Data

Nov. 28, 2006 (JP) ..... 2006-320136

(51) Int. Cl.
*B65H 31/26* (2006.01)

(52) U.S. Cl. ..... 271/220; 271/207; 270/58.08; 270/58.12

(58) Field of Classification Search ..... 271/207, 271/220, 221; 270/58.08, 58.12
See application file for complete search history.

(56) References Cited

U.S. PATENT DOCUMENTS 5,014,977 A * 5/1991 Moore et al. ..... 271/221
6,644,654 B1 * 11/2003 Mao ..... 271/220
2004/0070141 A1 * 4/2004 Michels et al. ..... 271/220
2007/0029723 A1 * 2/2007 Sato ..... 271/207
2007/0029724 A1 * 2/2007 Sato ..... 271/220

FOREIGN PATENT DOCUMENTS

JP 11-292387 10/1999
JP 2006-16090 1/2006

* cited by examiner

*Primary Examiner*—Kaitlin S Joerger
(74) *Attorney, Agent, or Firm*—Smith, Gambrell & Russell, LLP

(57) ABSTRACT

A paper pressing unit is composed of two cylindrical paper pressing portions, connecting members to which the paper pressing portions are each connected, and rotational shafts protruding outward from the central parts of the connecting members along the longer sides thereof, and is rotatably supported between frames provided inside the apparatus and disposed in the width direction of the processing tray (in the direction perpendicular to the plane of FIG. 2). The paper pressing portions are disposed in such a way that a surface of a circular cylinder whose cylindrical axis corresponds to a line passing through the rotational shafts is divided thereby into equal parts (into two equal parts). The paper pressing portions travel on the same orbit as the paper pressing unit rotates.

11 Claims, 14 Drawing Sheets

POST-PROCESSING APPARATUS AND IMAGE FORMING SYSTEM PROVIDED THEREWITH

This application is based on Japanese Patent Application No. 2006-320136 filed on Nov. 28, 2006, the contents of which are hereby incorporated by reference.

BACKGROUND OF THE INVENTION

1. Field of the Invention

The present invention relates to post-processing apparatuses that perform processing such as sorting and stapling for sheets of paper having an image formed thereon.

2. Description of Related Art

When a relatively large number of sheets of paper on which an image is formed by an image forming apparatus, such as a copier or a printer, need to be stapled (hereinafter "stapling") or punched (hereinafter "punching"), a so-called "finisher", which is a post-processing apparatus that automatically performs predetermined post-processing such as stapling or punching is useful.

FIG. 14 is a side sectional view showing an example of the structure of a conventional post-processing apparatus. In FIG. 14, a post-processing apparatus 100 is, for example, detachably connected to an image forming apparatus 101, such as a copier, a facsimile, or a printer, on a paper ejection side thereof. The post-processing apparatus 100 is provided with a processing tray 1 that can store a plurality of sheets of paper P. On the upper right of the processing tray 1 is provided a paper entrance 2. Near the paper entrance 2 is disposed a pair of receiving rollers 3. The sheets of paper having an image formed thereon are stapled, for example, as follows. The sheets of paper P sequentially ejected through a pair of ejection rollers 102 of the image forming apparatus 101 pass through the paper entrance 2 into the post-processing apparatus 100, are then conveyed to the processing tray 1 through the pair of receiving rollers 3 and a paper conveying path R, and are then temporarily stored in the processing tray 1.

The processing tray 1 is provided with a paper raising/lowering member 9 that can move up and down along a paper receiving surface. When the sheet of paper is being conveyed to the processing tray 1, the paper raising/lowering member 9 is made to wait in the lower part of the processing tray 1, whereby the leading edges of the sheets of paper P that have sequentially been conveyed through the pair of receiving rollers 3 to the processing tray 1 are supported by the paper raising/lowering member 9. Near the position where the paper raising/lowering member 9 is made to wait is provided a stapler 5. The stapler 5 staples a stack of paper whose leading edges are evened up by the paper raising/lowering member 9. The stapled stack of paper is conveyed to the upper part of the post-processing apparatus 100 by the paper raising/lowering member 9, and is then ejected through a pair of stack ejection rollers 6 into an eject tray 7.

With respect to the post-processing apparatus described above, the following problem arises. If the rear end of the sheet of paper conveyed to the processing tray 1 floats due to curling or static electricity, the leading edge of the next sheet of paper reaches under the sheet of paper that has already been placed on the processing tray 1, resulting in an undesirable change in the sequence of the stacked sheets of paper. Alternatively, the leading edge of the next sheet of paper bumps into the rear edge of the sheet of paper that has already been placed on the processing tray 1, resulting in the occurrence of a paper jam. This hinders the sheets of paper from being conveyed or stacked smoothly.

To avoid this problem, a method for preventing the sheets of paper from being unsuccessfully stacked due to floating of the rear end of the sheet of paper conveyed to the processing tray has been proposed. For example, JP-A-H11-292387 (hereinafter "Patent Document 1") discloses a post-processing apparatus provided with a swingable paper pressing portion that presses the rear end of the sheet of paper placed on a processing tray against the tray. According to the method disclosed in Patent Document 1, when a sheet of paper is conveyed to the processing tray and the rear end thereof passes through a pair of receiving rollers, a pressing member moves from a retracted position (a home position) to a paper pressing position so as to press the rear end of the sheet of paper against the processing tray. When the stapled stack of paper is ejected into the eject tray, the pressing member moves to the paper pressing position so as to serve as a stack ejection guide.

To achieve a proper swinging motion of the paper pressing portion between the retracted position and the paper pressing position, the movement of the paper pressing portion has to be regulated by using a stopper member located outside the range in which the paper pressing portion moves. By doing so, however, the paper pressing portion collides with the stopper member, causing collision noise. In addition, there is a possibility that the paper pressing portion collided with the stopper member and bounded back may fail to move to a given position, interfering with the reception of the next sheet of paper.

On the other hand, JP-A-2006-16090 (hereinafter "Patent Document 2") discloses a paper stacking mechanism that reduces the collision noise by reducing the speed of a swingable paper pressing plate by a gear mechanism, and enhances swing accuracy by minimizing the bound of the paper pressing plate. Certainly, with the mechanism disclosed in Patent Document 2, it is possible to stabilize a swinging motion of the paper pressing plate. However, since the paper pressing plate is retracted from the paper pressing position when the next sheet of paper is received, there is a possibility that the rear end of the stacked sheet of paper moves again away from the surface of the tray if it strongly curls or builds up static electricity. In addition, as is the case with Patent Document 1, since the paper pressing portion needs some time to swing back and forth, it is difficult to adopt this mechanism to a model that conveys a sheet of paper at high speed. It is for this reason that the above-described mechanism is not good enough to prevent the sheets of paper from being unsuccessfully stacked, and is susceptible to further improvement.

SUMMARY OF THE INVENTION

In view of the conventionally experienced problems described above, it is an object of the present invention to provide post-processing apparatuses that can smoothly convey sheets of paper to a processing tray, stack them one on top of another in a stable manner, and process them with a high degree of efficiency by reliably preventing the rear end of the sheet of paper placed on the processing tray from floating.

To achieve the above object, according to one aspect of the present invention, a post-processing apparatus is provided with: a processing tray on which a plurality of sheets of paper are placed; a pair of conveying rollers provided on the upstream side of the processing tray along a conveying direction thereof, the pair of conveying rollers conveying a sheet of paper to the processing tray; and a paper pressing member disposed near the upstream end of the processing tray so as to face the upstream end of the processing tray, the paper pressing member pressing the rear end of the sheet of paper placed on the processing tray against the processing tray. The paper pressing member includes: a paper pressing unit having rotational shafts each extending in a direction that is parallel to a paper receiving surface of the processing tray and is orthogonal to a direction in which the sheet of paper is conveyed, and a plurality of paper pressing portions each being disposed parallel to the rotational shafts and having a surface at which the paper pressing portion is brought into contact with the sheet of paper, the surface being located on a surface of a circular cylinder whose cylindrical axis corresponds to a line passing through the rotational shafts; and a unit driving motor driving the paper pressing unit to rotate. Here, the paper pressing member sequentially presses the rear end of each sheet of paper conveyed to the processing tray by rotating the paper pressing unit in a direction opposite to the direction in which the sheet of paper is conveyed.

With this structure, the paper pressing unit is rotated in one direction. This helps prevent the bound of the paper pressing portion, ensuring smooth movement of the paper pressing portion. In addition, this makes it easier to control the driving of the unit driving motor. Furthermore, since a plurality of paper pressing portions are used by turns and each of them is disposed in a paper pressing position once in one turn of the paper pressing unit, the post-processing apparatus can be used with a fast-speed image forming apparatus, enhancing post-processing efficiency.

Preferably, in the post-processing apparatus structured as described above, the length of the paper pressing portion is longer than a maximum width of paper to be conveyed to the processing tray.

With this structure, the sheet of paper conveyed to the processing tray is pressed evenly across the width thereof by the paper pressing portion. This makes it possible to effectively prevent the sheet of paper from floating.

Preferably, in the post-processing apparatus structured as described above, the paper pressing portions are individually brought into contact with the sheet of paper at the surfaces thereof, the surfaces being located on the surface of the circular cylinder whose cylindrical axis corresponds to the line passing through the rotational shafts in such a way as to divide the surface of the circular cylinder into equal parts.

With this structure, the paper pressing portions are disposed in the paper pressing position one at a time at regular intervals while the paper pressing unit is rotating one turn. This makes it easier to synchronize the rotation of the paper pressing unit with the timing with which the sheet of paper is conveyed.

Preferably, in the post-processing apparatus structured as described above, the paper pressing portions each have at least a curved surface at which the paper pressing portion is brought into contact with the sheet of paper.

With this structure, since the paper pressing portions each have at least a curved surface at which the paper pressing portion is brought into contact with the sheet of paper, the friction between the paper pressing portion and the sheet of paper is reduced. This makes it possible to convey the sheet of paper to the processing tray and place it thereon more smoothly.

Preferably, in the post-processing apparatus structured as described above, the paper pressing unit has a space between the rotational shafts and the paper pressing portions, and the next sheet of paper passing through the pair of conveying rollers is conveyed to the processing tray through the space while the rear end of the sheet of paper that has already been placed on the processing tray is pressed by one of the plurality of paper pressing portions.

With this structure, the next sheet of paper is conveyed to the processing tray through the space between the paper pressing portions and the rotational shafts while the rear end of the sheet of paper that has already been placed on the processing tray is pressed by one of the paper pressing portions. This makes it possible to reliably prevent the leading edge of the next sheet of paper from bumping into the rear edge of the sheet of paper that has already been placed on the processing tray and causing a paper jam, and prevent the leading edge of the next sheet of paper from reaching under the sheet of paper that has already been placed on the processing tray and causing an undesirable change in the sequence of the stacked sheets of paper.

Preferably, in the post-processing apparatus structured as described above, the paper pressing unit has a pair of connecting members disposed with a space left therebetween, the space being wider than the maximum width of paper to be conveyed to the processing tray, the pair of connecting members to which the paper pressing portions are each connected at both ends thereof. The rotational shafts each protrude outward from a central part of a corresponding one of the connecting members.

With this structure, the rotational shafts of the paper pressing unit protrude from the central parts of the pair of connecting members to which the paper pressing portions are each connected at both ends thereof. This helps achieve a paper pressing unit having no rotational shaft inside it, making it possible to pass the sheet of paper more smoothly.

Preferably, in the post-processing apparatus structured as described above, cylindrical members are provided around the paper pressing portions in such a way that the cylindrical members can rotate around the paper pressing portions.

With this structure, the rotation of the cylindrical members provided around the paper pressing portions helps further reduce the friction between the paper pressing portion and the sheet of paper.

Preferably, in the post-processing apparatus structured as described above, the paper pressing portions are individually brought into contact with the sheet of paper at the surfaces thereof, the surfaces being located on the surface of the circular cylinder whose cylindrical axis corresponds to the line passing through the rotational shafts in such a way as to divide the surface of the circular cylinder into two equal parts.

With this structure, it is possible to achieve the most simplified structure of the paper pressing unit. This advantageously reduces costs, and minimizes the friction between the paper pressing portion and the sheet of paper.

Preferably, the post-processing apparatus structured as described above is further provided with: a paper detecting sensor that detects a sheet of paper transported into the post-processing apparatus; a pressing portion detecting sensor that detects the positions of the paper pressing portions; and a controller that controls the rotation of the paper pressing unit based on the detection results of the paper detecting sensor and the pressing portion detecting sensor.

With this structure, it is possible to synchronize the timing with which the sheet of paper is conveyed with the timing with which the paper pressing portion presses the sheet of paper. This makes it possible to more reliably prevent, for example, a paper jam in the processing tray, and prevent the leading edge of the next sheet of paper from reaching under the sheet of paper that has already been placed on the processing tray and causing an undesirable change in the sequence of the stacked sheets of paper.

Preferably, in the post-processing apparatus structured as described above, the controller changes the rotational speed of the unit driving motor depending on the length of a sheet of paper in the direction in which the sheet of paper is conveyed to the processing tray.

With this structure, the rotational speed of the unit driving motor is changed depending on the length of a sheet of paper in the direction in which the sheet of paper is conveyed. This makes it possible to press the rear end of the sheet of paper with appropriate timing according to the timing with which the sheet of paper is conveyed to the processing tray, the timing varying with the length of the sheet of paper.

Preferably, in the post-processing apparatus structured as described above, the controller controls the paper pressing unit to rotate one turn at different rotational speeds depending on the time the sheet of paper takes to be placed on the processing tray.

With this structure, the paper pressing unit is controlled to rotate one turn at different rotational speeds. This makes it possible to press the rear end of the sheet of paper with appropriate timing without interfering with the transportation of the next sheet of paper.

According to another aspect of the present invention, an image forming system is provided with: the post-processing apparatus structured as described above; and an image forming apparatus from which a sheet of paper having an image formed thereon is transported into the post-processing apparatus.

With this structure, it is possible to provide a convenient image forming system that performs all the processes from image formation to post-processing.

DETAILED DESCRIPTION OF PREFERRED EMBODIMENTS

Figure 1:
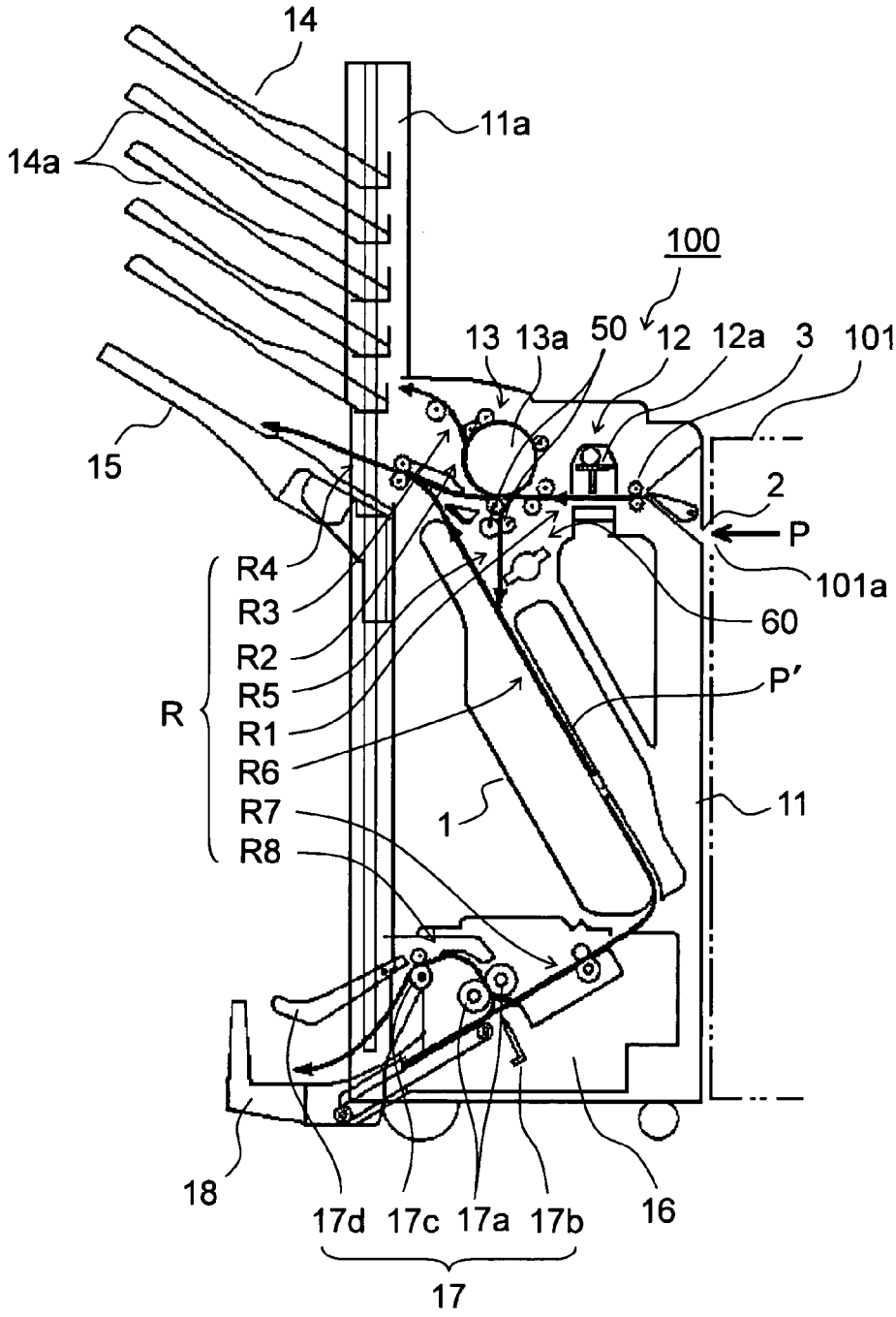
FIG. 1 is a side sectional view showing the overall structure of a post-processing apparatus of the present invention.
Figure 14:
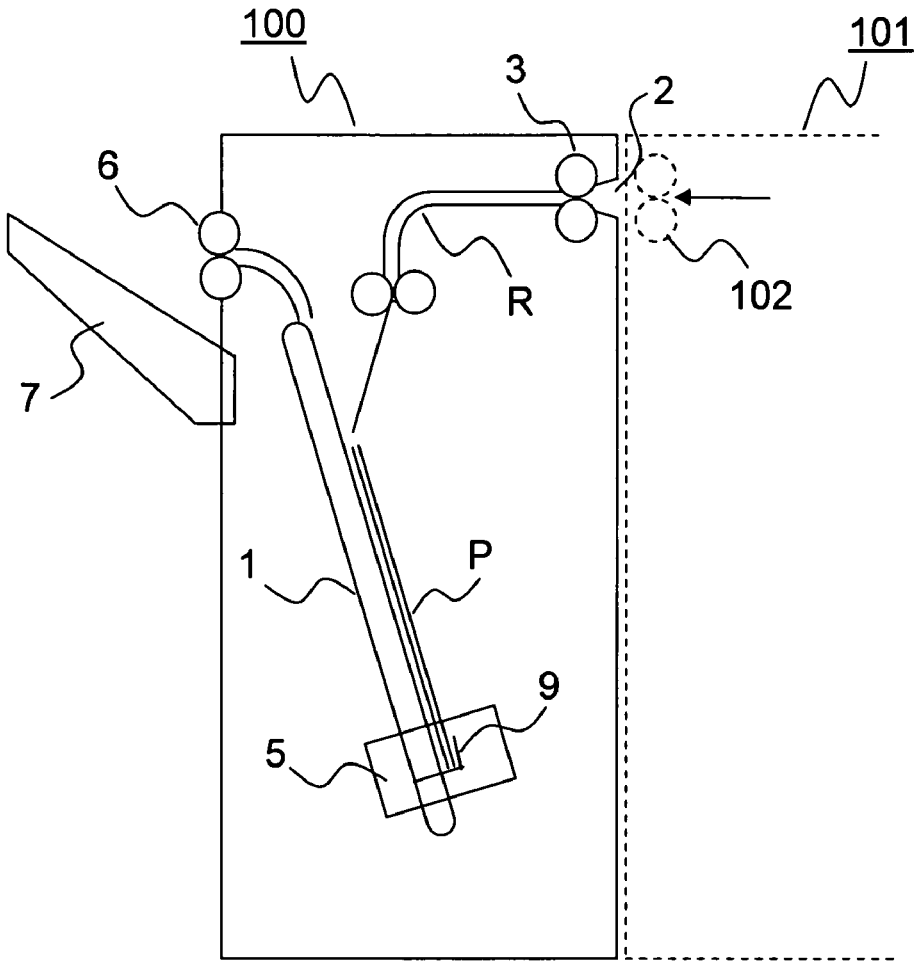
FIG. 14 is a diagram showing an outline of the overall structure of a conventional post-processing apparatus.

Hereinafter, an embodiment of the present invention will be described with reference to the accompanying drawings. FIG. 1 is a side sectional view showing the internal structure of a post-processing apparatus according to an embodiment of the present invention. In the following description, such members as are found also in the conventional example shown in FIG. 14 will be identified with common reference characters, and their explanations will not be repeated. As shown in FIG. 1, the post-processing apparatus 100 is formed as a vertically long, box-shaped cabinet 11 incorporating, along a paper conveying path R, a punching portion 12 that punches a sheet of paper P, a paper sorting portion 13 disposed downstream of the punching portion 12 (in FIG. 1, leftward as seen from the viewer facing it) for sorting the sheets of paper P into different destinations, a processing tray 1 disposed below the paper sorting portion 13 for temporarily storing the sheets of paper P (a stack of paper P') and stapling the stack of paper P', and a folding portion 16 that folds the stapled stack of paper P' in half.

Outside the cabinet 11 are provided a job tray 14 planted on the back face of the cabinet 11, a general-purpose tray 15 disposed below the job tray 14, and a folded-paper reception tray 18 disposed along the bottom edge of the cabinet 11 in such a way as to face the general-purpose tray 15. Unfolded sheets of paper P or an unfolded stack of paper P' are ejected into the job tray 14 and into the general-purpose tray 15, while a stack of paper P' folded in half by the folding portion 16 is ejected into the folded-paper reception tray 18.

The paper conveying path R is composed of: an entrance-side conveying path R1 running from a paper entrance 2 provided in the upper part of the cabinet 11 on the front face thereof (in FIG. 1, rightward as seen from the viewer facing it) to the paper sorting portion 13; a ring-shaped conveying path R2 leading from the entrance-side conveying path R1, the ring-shaped conveying path R2 being formed in the paper sorting portion 13; a conveying path R3 branched off from the ring-shaped conveying path R2, leading to the job tray 14 provided on the back of the cabinet 11 in an upper part thereof; a conveying path R4 branched off from the ring-shaped conveying path R2, running from the paper sorting portion 13 to the general-purpose tray 15 passing under the conveying path R3; a conveying path R5 running downward from the paper sorting portion 13 to the processing tray 1; a conveying path R6 formed so as to pass vertically through the processing tray 1; a conveying path R7 formed so as to pass diagonally through the folding portion 16, in such a way as to communicate with the conveying path R6; and an ejecting/conveying path R8 for ejecting a stack of paper P' folded in half by the folding portion 16.

A pair of receiving rollers 3 is provided along the entrance-side conveying path R1. In the immediate vicinity of the pair of receiving rollers 3, a paper detecting sensor 20 (see FIG. 2) for detecting the reception of a sheet of paper is disposed upstream of the pair of receiving rollers 3 along the entrance-side conveying path R1. The punching portion 12 includes a punching mechanism 12*a* that moves a punching blade up and down, and is disposed above the entrance-side conveying path R1. In a case where an instruction is given to form a punched hole, the sheet of paper P being conveyed through the entrance-side conveying path R1 is temporarily stopped under the punching portion 12, and the punching mechanism 12*a* is driven to move the punching blade up and down, and thereby form a punched hole in a given position.

The paper sorting portion 13 has a sidetrack drum 13*a* that guides the sheet of paper P conveyed through the entrance-side conveying path R1 to the conveying path R5. When the sheet of paper P is directly conveyed from the entrance-side conveying path R1 to the conveying path R5, the sidetrack drum 13*a* prevents the sheet of paper P from being bent at almost a right angle, thereby smoothly conveying the sheet of paper P to the conveying path R5. The sidetrack drum 13*a* is rotated clockwise around a shaft center thereof in such a way as to guide the sheet of paper P along a circumferential surface thereof. As a result, the sheet of paper P is guided to the conveying path R5 without bending greatly.

The paper sorting portion 13 is provided with path switching members (not shown) in appropriate positions. As a result, the sheet of paper P transported from the image forming apparatus 101 through the paper entrance 2 to the entrance-side conveying path R1 is conveyed over a conveying path set by a predetermined switching operation of the path switching members, and is eventually sent to a destination thereof. The ring-shaped conveying path R2 formed in the paper sorting portion 13 is used for making the sheet of paper transported from the image forming apparatus 101 wait temporarily while the stack of paper P' is stapled in the processing tray 1, or the stapled stack of paper P' is conveyed to the conveying path R3, to the conveying path R4, or to the conveying path R7.

A pair of conveying rollers 50 for pushing the sheet of paper P toward the conveying path R6 is provided about half way along the conveying path R5. As the pair of conveying rollers 50 is rotated, the sheet of paper P is introduced into the conveying path R6 at a constant speed.

The job tray 14 is composed of a plurality of unit trays 14*a* that are vertically arranged and are laid one on top of another at regular intervals, such that one of the unit trays 14*a* can be selected according to the type of job. To permit such selection, the job tray 14 can move up and down along a support column 11*a* provided on the back face of the cabinet 11 in the upright position. When a desired unit tray 14*a* is selected, the selected unit tray 14*a* is moved in such a way that the base portion thereof faces the most downstream end of the conveying path R3. As a result, the sheet of paper P conveyed over the conveying path R3 is ejected into the selected unit tray 14*a*.

The general-purpose tray 15 receives a sheet of paper P or a stack of paper P' whose destination in the job tray 14, namely a particular unit tray 14*a*, has not been expressly specified, that is, a common sheet of paper P ejected through the conveying path R4 and a stack of paper P' subjected to predetermined post-processing along the conveying path R6 and then ejected through the conveying path R4. The general-purpose tray 15 is disposed in such a way that the base portion thereof faces the most downstream end of the conveying path R4.

The processing tray 1 temporarily stores a plurality of sheets of paper P sequentially conveyed over the conveying path R5 to the conveying path R6, and thereby forms a stack of paper P'. In addition, the processing tray 1 evens up the edges of the stack of paper P', and staples the stack of paper P' with a stapler 5 (which will be described later). The conveying path R5 is disposed so that the most downstream end thereof faces the conveying path R6 at a position higher than the midpoint thereof. The conveying path R6 communicates, at an upper end thereof, with the conveying path R4.

Thus, the sheets of paper P temporarily introduced into the conveying path R6 through the conveying path R5 are stacked one on top of another, are then stapled together as a stack of paper P', and are then ejected from the upper end of the conveying path R6 into the general-purpose tray 15 through the conveying path R4.

The folding portion 16 folds the stack of paper P' in half, the stack of paper P' that has been stapled in the middle in the processing tray 1. The folding portion 16 is provided with a folding unit 17. The folding unit 17 includes: a pair of folding rollers 17*a* provided above the middle of the conveying path R7; a plate-like press member 17*b* disposed below the conveying path R7 in such a way as to face the pair of folding rollers 17*a* and intersect the conveying path R7; a pair of ejecting rollers 17*c* disposed at the most downstream end of the ejecting/conveying path R8; and a pressing member 17*d* disposed on the downstream side of the pair of ejecting rollers 17*c* in such a way that it can swing around a predetermined shaft.

The press member 17*b* is driven by an unillustrated driver to press the middle of the stack of paper P', which has been stapled in the middle and conveyed to the conveying path R7, into a space between the pair of folding rollers 17*a*. The stack of paper P' that has been pressed by the press member 17*b* and folded in half is drawn into the ejecting/conveying path R8 as the pair of folding rollers 17*a* is driven, and is then ejected into the folded-paper reception tray 18 through the ejecting/conveying path R8, the pair of ejecting rollers 17*c*, and the pressing member 17*d*.

Figure 2:
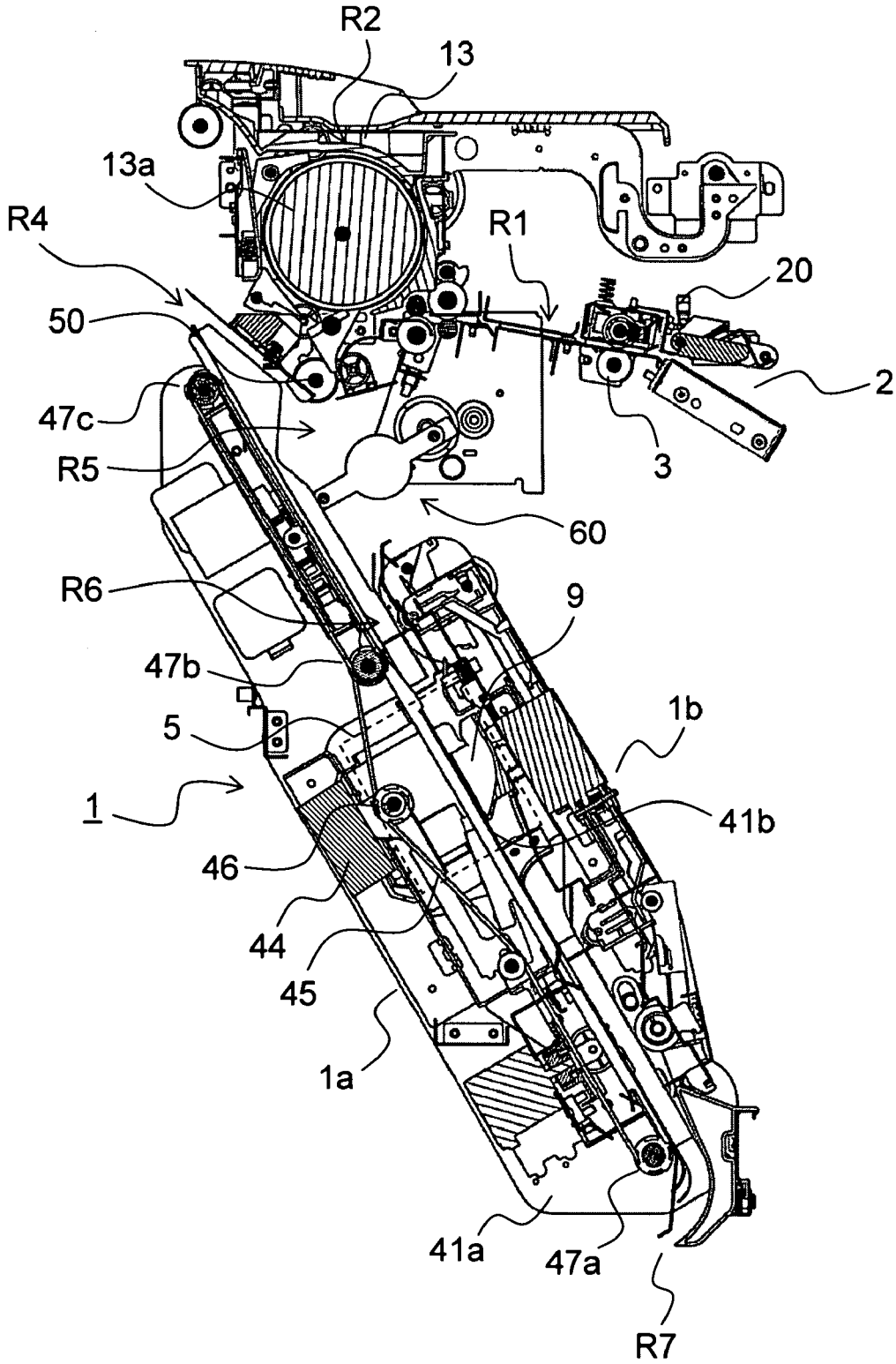
FIG. 2 is a partial sectional view showing the structure of a part of the post-processing apparatus of the present invention around the processing tray.

FIG. 2 is a side view showing the structure of a part of the post-processing apparatus of the invention around the processing tray. Hereinafter, referring to FIG. 1 as appropriate, the structure of a part of the post-processing apparatus of the invention around the processing tray will be described with reference to FIG. 2. The processing tray 1 is composed of a receiving unit 1*a* that receives a sheet of paper P conveyed over the conveying path R5 and a cover unit 1*b* that can cover/uncover a paper receiving surface of the receiving unit 1*a*. Between the receiving unit 1*a* and the cover unit 1*b* is formed the conveying path R6.

The receiving unit 1*a* includes a pair of side plates 41*a* whose length is so set that an upper end part of each side plate 41*a* faces the conveying path R4 and a lower end part thereof is located on the lower right of the cabinet 11 shown in FIG. 1, the pair of side plates 41*a* being diagonally disposed; a paper receiving plate 41*b* that is supported between the side plates 41*a* and forms the paper receiving surface; a paper raising/lowering member 9 that supports the lower end portion of the sheet of paper P introduced to the paper receiving plate 41*b* and raises/lowers the stack of paper P', namely the sheets of paper P stacked one on top of another, along the paper receiving plate 41*b*; a stapler 5 provided roughly in the center of the paper receiving plate 41*b*; an up-and-down endless belt 45 that moves the paper raising/lowering member 9 up and down along the paper receiving plate 41*b*, and the like.

The up-and-down endless belt 45 is disposed in such a way as to be caught in a space formed in the paper receiving plate 41*b*. As shown in FIG. 2, the up-and-down endless belt 45 is stretched around a predetermined number of belt supporting rollers composed of a driving roller 46 fixed to a driving shaft of a belt driving motor 44 disposed between the side plates 41, and driven rollers 47*a* to 47*c*. The up-and-down endless belt 45 is driven in the forward/reverse direction by the belt driving motor 44 so as to rotate in a predetermined direction. The paper raising/lowering member 9 is fixed to the up-and-down endless belt 45, and is moved up and down along the paper receiving plate 41*b* as the up-and-down endless belt 45 is rotated in the forward/reverse direction.

The stapler 5 staples a stack of paper P' supported by the paper raising/lowering member 9 between the receiving unit 1*a* and the cover unit 1*b* of the processing tray 1. The stapler 5 has a staple feeding mechanism, a staple driving mechanism that drives the fed staple into the stack of paper P', or the like, but no description will be given of these mechanisms.

The paper raising/lowering member 9 can swing around the lowermost driven roller 47*a* in such a way as to move from a paper supporting position located between the receiving unit 1*a* and the cover unit 1*b* to a retracted position located in the lower part between the side plates 41*a*. When the paper raising/lowering member 9 is moved to the retracted position, the conveying path R6 communicates with the conveying path R7, allowing the stack of paper P' stapled in the middle by the stapler 5 for the next folding process to be conveyed to the conveying path R7.

The cover unit 1*b* is placed over the receiving unit 1*a* in such a way as to face the paper receiving plate 41*b* of the receiving unit 1*a*, so as to help a stack of paper P' composed of the sheets of paper P conveyed to the conveying path R6 move up and down. The cover unit 1*b* has a receiving part (not shown) in a position where it faces the stapler 5. This receiving part serves as a receiving stage in which the stapler 5 staples the stack of paper P', and has provided therein a clincher portion for stapling the stack of paper P' in the middle.

The cover unit 1*b* is supported in such a way that it can rotate around a shaft of the driven roller 47*a*, and can be selectively moved between a closed position (a state shown in FIG. 2) in which the conveying path R6 is closed and an opened position in which the conveying path R6 is opened.

Diagonally above the upper end part of the cover unit 1*b* and near a part of the conveying path R5 located almost immediately below the pair of conveying rollers 50, the part being located the most downstream of the conveying path R5 along a conveying direction thereof, is disposed a paper pressing unit 60 in such a way as to face the paper receiving plate 41*b*. The paper pressing unit 60 presses the rear end (the upper end) of a sheet of paper P conveyed to the conveying path R6 via the pair of conveying rollers 50 against the paper receiving plate 41*b*.

Figure 3:
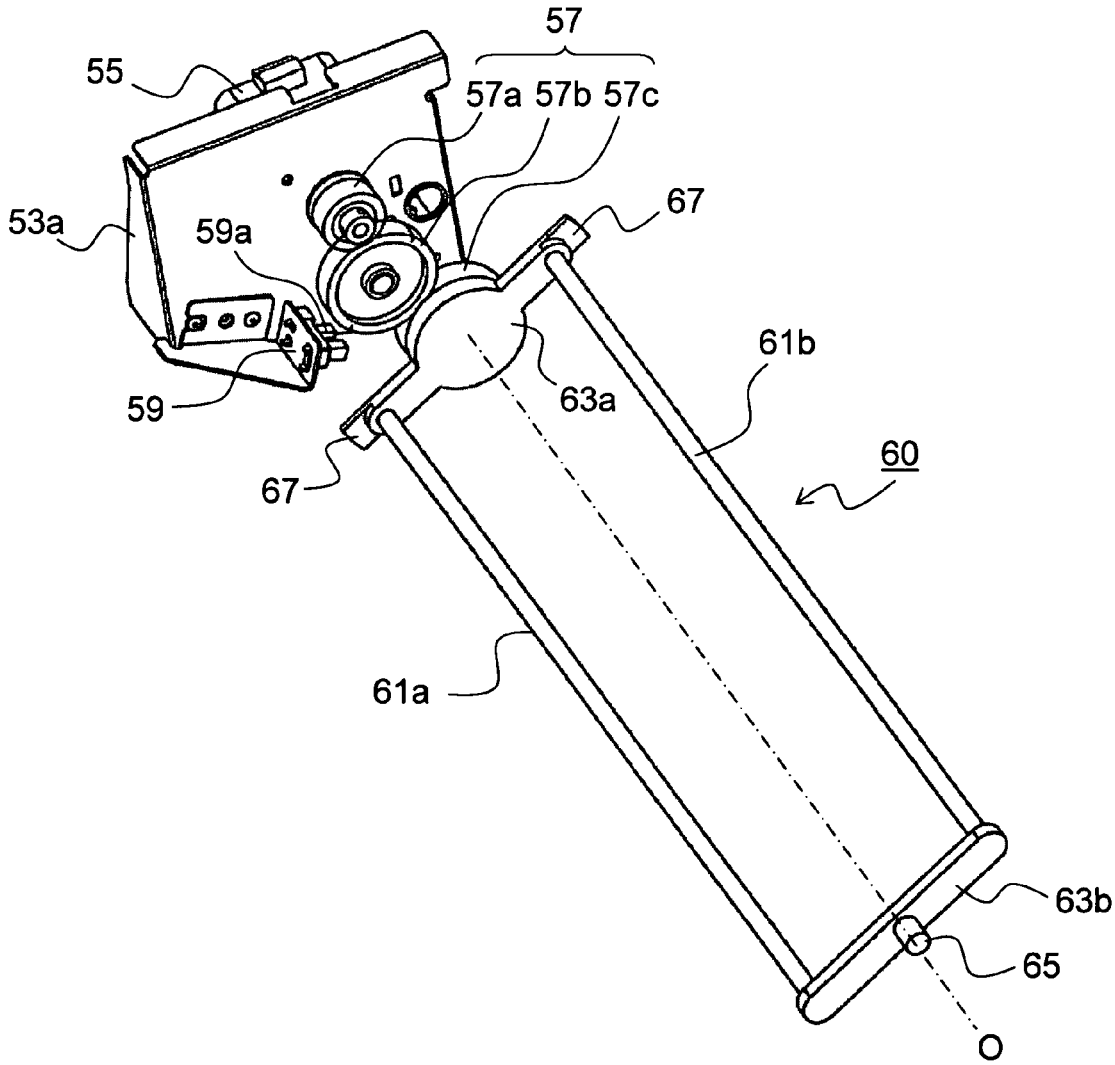
FIG. 3 is a perspective view showing the structure of the paper pressing unit used in the post-processing apparatus of the present invention.

FIG. 3 is a perspective view showing the paper pressing unit 60 and a part around it. The paper pressing unit 60 is composed of two cylindrical paper pressing portions 61*a* and 61*b*, connecting members 63*a* and 63*b* to which the paper pressing portions 61*a* and 61*b* are each connected at both ends thereof, and rotational shafts 65 protruding outward from the central parts of the connecting members 63*a* and 63*b* along the longer sides thereof. The paper pressing unit 60 is rotatably supported between frames 53*a* and 53*b* provided inside the apparatus and disposed in the width direction of the processing tray 1 (in the direction perpendicular to the plane of FIG. 2). The rotational shafts 65 are disposed in a direction that is parallel to the paper receiving surface of the processing tray 1 and is orthogonal to the direction in which the sheet of paper is conveyed. FIG. 3 shows only the structure on the side of the frame 53*a*.

Behind the frame 53*a* is disposed a unit driving motor 55, from which the driving force is transferred to the paper pressing unit 60 via a gear array 57 composed of a drive output gear 57*a* fixed to a motor output shaft, an idle gear 57*b*, and a drive input gear 57*c* fixed to the rotational shaft 65 (not shown) located on the side of the connecting member 63*a*. Used as the unit driving motor 55 is a stepping motor that can easily control the rotational speed and the angle (amount) of rotation by controlling the drive pulse The paper pressing portions 61*a* and 61*b* are connected to the connecting members 63*a* and 63*b* so as to be equidistant from the rotational shafts 65. That is, the paper pressing portions 61*a* and 61*b* are disposed parallel to the rotational shafts 65 in such a way that a surface of a circular cylinder whose cylindrical axis corresponds to a line O passing through the rotational shafts 65 is divided thereby into equal parts (into two equal parts). The paper pressing portions 61*a* and 61*b* travel on the same orbit as the paper pressing unit 60 rotates.

The frame 53*a* is provided with a pressing portion detecting sensor 59 that detects the positions of the paper pressing portions 61*a* and 61*b*. The pressing portion detecting sensor 59 is provided with a detecting portion 59*a* shaped like a letter U and having a light-emitting portion and a light-receiving portion on the inward-looking faces thereof. When one of flags 67 formed at both ends of the connecting member 63*a* so as to protrude therefrom is passing through the detecting portion 59*a*, an optical path is blocked; when it has passed therethrough, the optical path is opened. As a result of the optical path being blocked/opened, the level the optical signal received by the detecting portion 59*a* is switched from HIGH to LOW/from LOW to HIGH. That is, based on the timing with which the level of the received optical signal is switched and the number of drive pulses of the unit driving motor 55, it is possible to accurately detect the positions of the paper pressing portions 61*a* and 61*b*.

Figure 4:
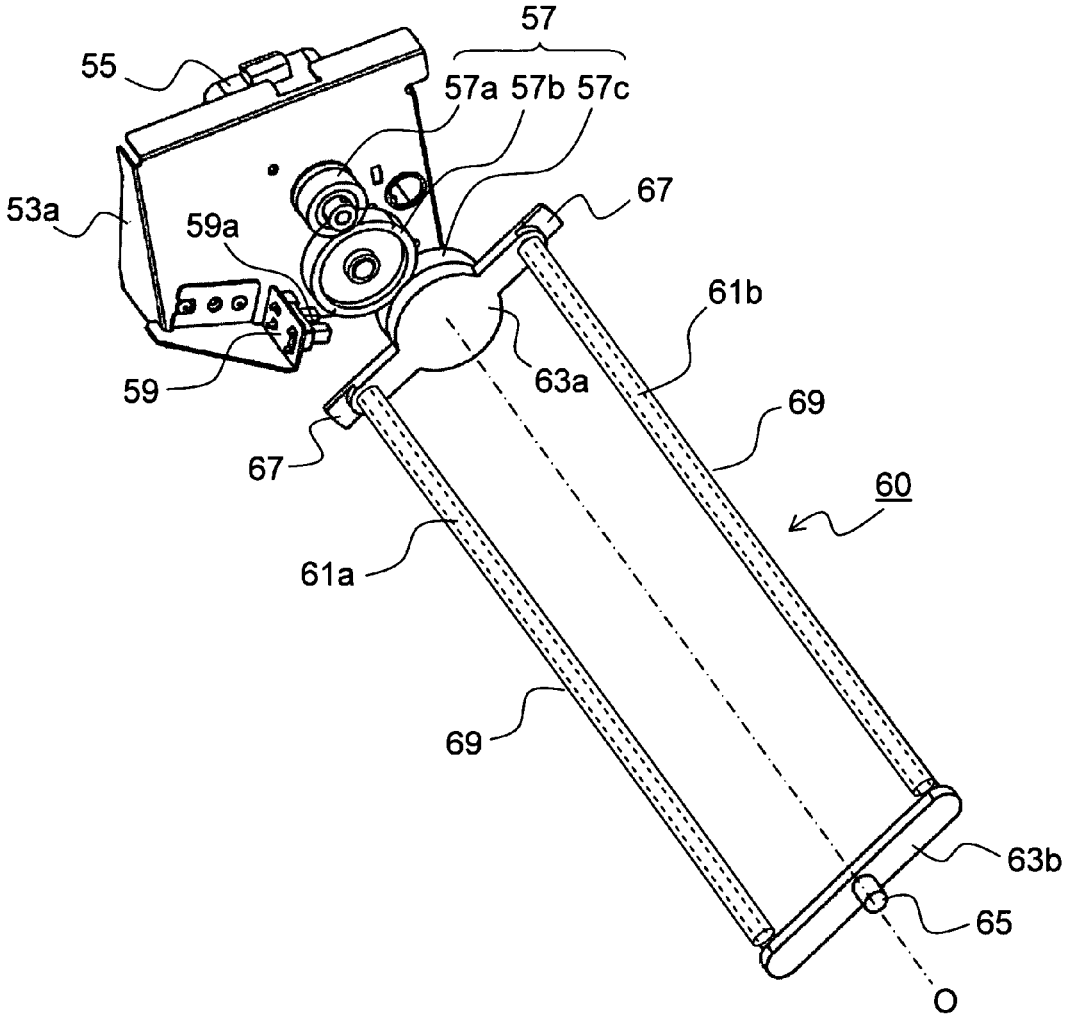
FIG. 4 is a perspective view showing an example in which a cylindrical member is provided around a paper pressing portion.

The shape of the paper pressing portions 61*a* and 61*b* is not limited to cylindrical, but may be any other shape, such as semicircular or prismatic. However, from the viewpoint of minimizing the friction with the sheet of paper, it is preferable to form the paper pressing portion so as to have at least a curved surface at which the paper pressing portion is brought into contact with the sheet of paper. As shown in FIG. 4, cylindrical members 69 may be provided around the paper pressing portions 61*a* and 61*b* in such a way that they can rotate around the paper pressing portions 61*a* and 61*b*. With this structure, it is possible to further reduce the friction with the sheet of paper by rotating the cylindrical members 69.

Incidentally, the rotational shaft 65 may be provided in such a way as to pass completely through the paper pressing unit 60 in the direction along the longer sides thereof. However, as will be described later, since the sheet of paper is conveyed to the processing tray 1 after passing through a space between the paper pressing portions 61*a* and 61*b*, it is more preferable to adopt the structures shown in FIGS. 3 and 4 because the absence of the rotational shaft 65 between the paper pressing portions 61*a* and 61*b* allows the sheet of paper to pass smoothly.

Figure 5:
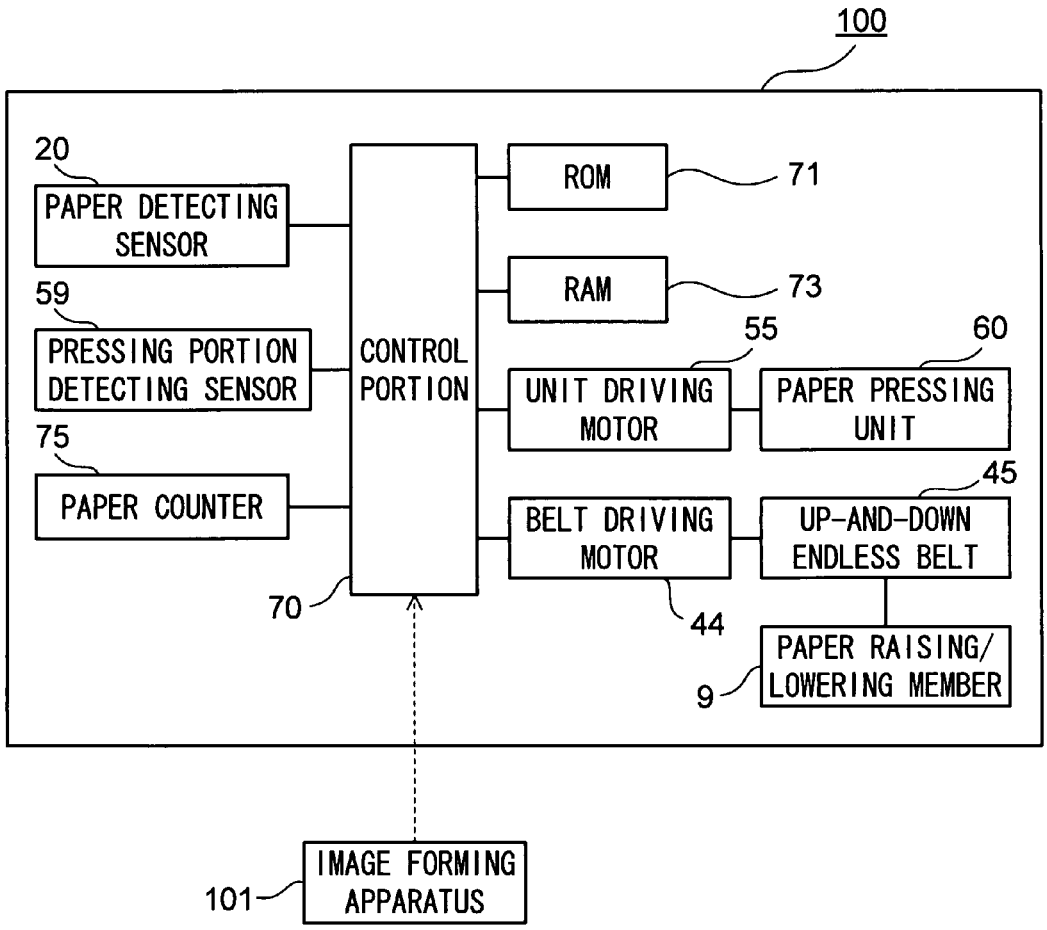
FIG. 5 is a block diagram showing the control pathway of the post-processing apparatus of the present invention.

FIG. 5 is a block diagram showing the control pathway of the post-processing apparatus of the present invention. As shown in FIG. 5, the basic configuration of the post-processing apparatus 100 is a control portion 70 that is a central processing unit (CPU), and the paper detecting sensor 20, the belt driving motor 44, the unit driving motor 55, the pressing portion detecting sensor 59, a ROM 71, a RAM 73, and a paper counter 75 which are connected to the control portion 70.

The ROM 71 stores different programs for controlling the different parts of the apparatus. These programs are read by the control portion 70 whenever the post-processing apparatus 100 is turned on. On the other hand, the RAM 73 is used to calculate data required for control and to temporarily store data.

The paper detecting sensor 20 detects the sheet of paper P transported through the paper entrance 2 to the entrance-side conveying path R1 via the pair of receiving rollers 3 (of which all are shown in FIG. 2). A detection signal is transmitted to the control portion 70 every time the paper detecting sensor 20 detects the sheet of paper. Used as the paper detecting sensor 20 are various types of sensors that can detect whether the sheet of paper is passed or not, such as an arm-type sensor that detects the sheet of paper by directly hitting it, and a reflection-type sensor having a light-emitting portion that emits light to the sheet of paper and a light-receiving portion that detects light reflected from the surface of the sheet of paper.

Since size information of the sheet of paper transported from the image forming apparatus 101 into the post-processing apparatus 100 is previously inputted to the control portion 70, the control portion 70 transmits a control signal to the belt driving motor 44 to achieve a given amount of rotation of the up-and-down endless belt 45, thereby moving the paper raising/lowering member 9 to a predetermined position according to the paper size. Though not illustrated, a raising/lowering member position sensor that detects the position of the paper raising/lowering member 9 is provided in an appropriate position. In the example shown in FIG. 2, the raising/lowering member position sensor is provided near the belt driving motor 44, so as to detect the level of the paper raising/lowering member 9 by detecting the number of rotations of the belt driving motor 44.

In response to the detection signal transmitted from the paper detecting sensor 20, the control portion 70 transmits a control signal to the unit driving motor 55, such that the paper pressing unit 60 is rotated with a predetermined timing and the paper pressing portions 61*a* and 61*b* are by turns disposed in a position (a paper pressing position) where the rear end of the sheet of paper is pressed thereby and prevented from floating. The positions of the paper pressing portions 61*a* and 61*b* are detected by the pressing portion detecting sensor 59. How to control the operation of the paper pressing unit 60 will be described later in detail.

Other controls performed by the control portion 70 are as follows. In a case where an instruction is given to form a punched hole, a sheet of paper is so controlled as to temporarily stop under the punching portion 12 (see FIG. 1), such that a punched hole is formed in a given position. In a case where an instruction is given to sort the sheets of paper, a predetermined unit tray 14*a* (see FIG. 1) is selected according to the paper size, and the job tray 14 is moved up and down along the support column 11*a*, such that the base portion of the selected unit tray 14*a* faces the most downstream end of the conveying path R3.

The paper counter 75 counts the number of sheets of paper every time the paper detecting sensor 20 detects the sheet of paper. Since information about the number of sheets of paper to be transported from the image forming apparatus 101 into the post-processing apparatus 100 is previously inputted to the control portion 70, the control portion 70 transmits a control signal to the unit driving motor 55 when the number of sheets of paper counted by the paper counter 75 reaches the number defined by the information. The unit driving motor 55 rotates the paper pressing unit 60 by a given amount, thereby moving one of the paper pressing portions 61*a* and 61*b* to a guide position so as to eject the stack of paper whose edges are evened up and are then stapled together on the conveying path R6.

In a case where the stack of paper is then ejected into the general-purpose tray 15 through the conveying path R4, a control signal for moving the paper raising/lowering member 9 upward near the pair of conveying rollers 50 is transmitted to the belt driving motor 44. On the other hand, in a case where the stack of paper is folded in half by the folding portion 16, a control signal for moving the paper raising/lowering member 9 to the retracted position is transmitted to the belt driving motor 44, such that conveying path R6 communicates with the conveying path R7. Then, the paper raising/lowering member 9 is reset to its initial position so that it can receive the sheet of paper and handle the next job.

Figure 6:
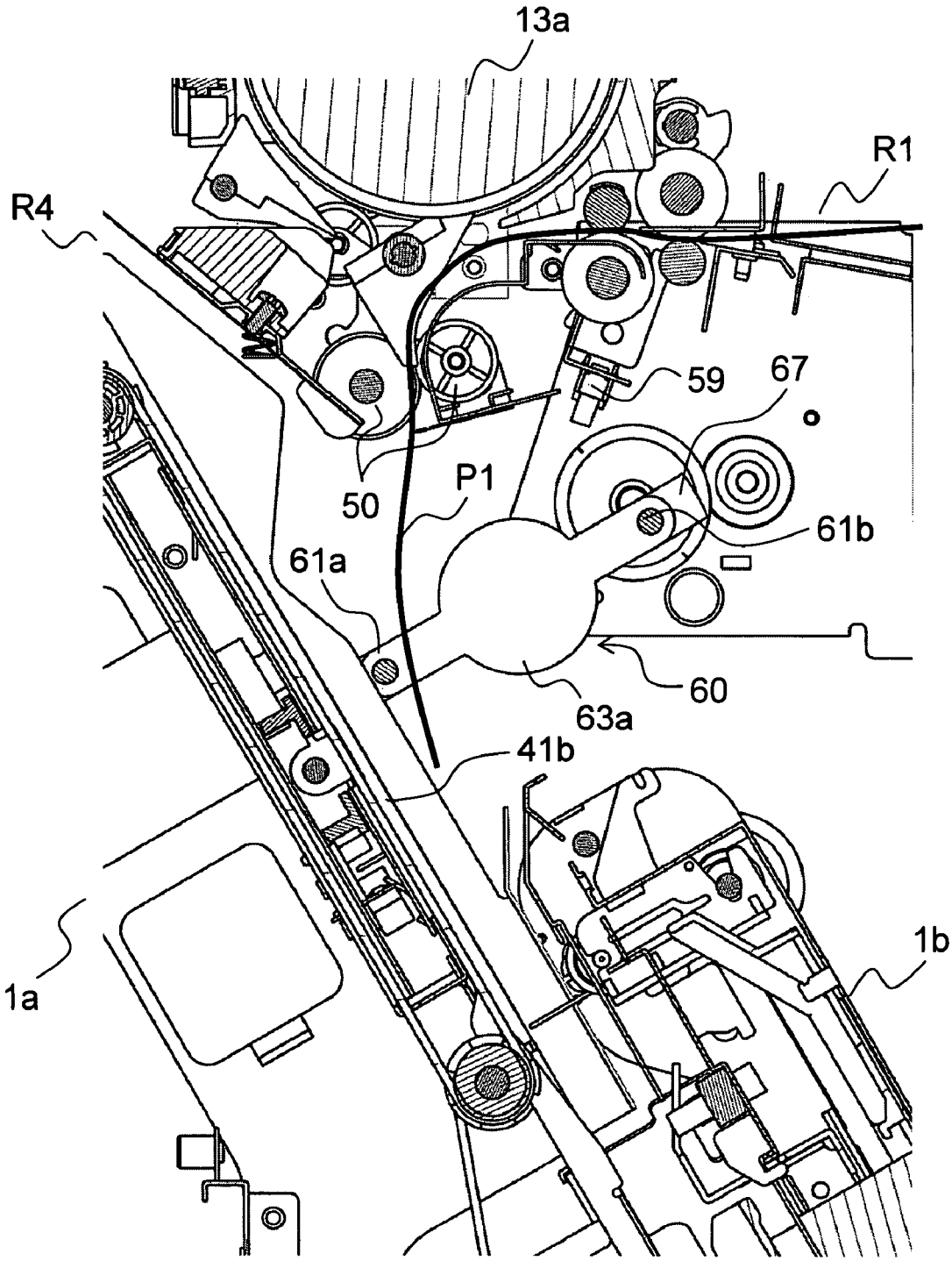
FIG. 6 is a partial sectional view of a part of the post-processing apparatus of the present invention around the paper pressing unit (a state in which the first sheet of paper P1 starts being conveyed)

FIGS. 6 to 11 are partial sectional views of a part of the post-processing apparatus around the paper pressing unit. With reference to FIG. 5, the operation of the paper pressing unit 60 incorporated in the post-processing apparatus of the present invention will be described in detail by using FIGS. 6 to 11. As shown in FIG. 6, before a sheet of paper is received, the paper pressing unit 60 is located in a position in which the connecting member 63*a* is nearly perpendicular to the paper receiving plate 41*b*. In this position, the paper pressing portion 61*a* is located close to the paper receiving plate 41*b*.

Figure 7:
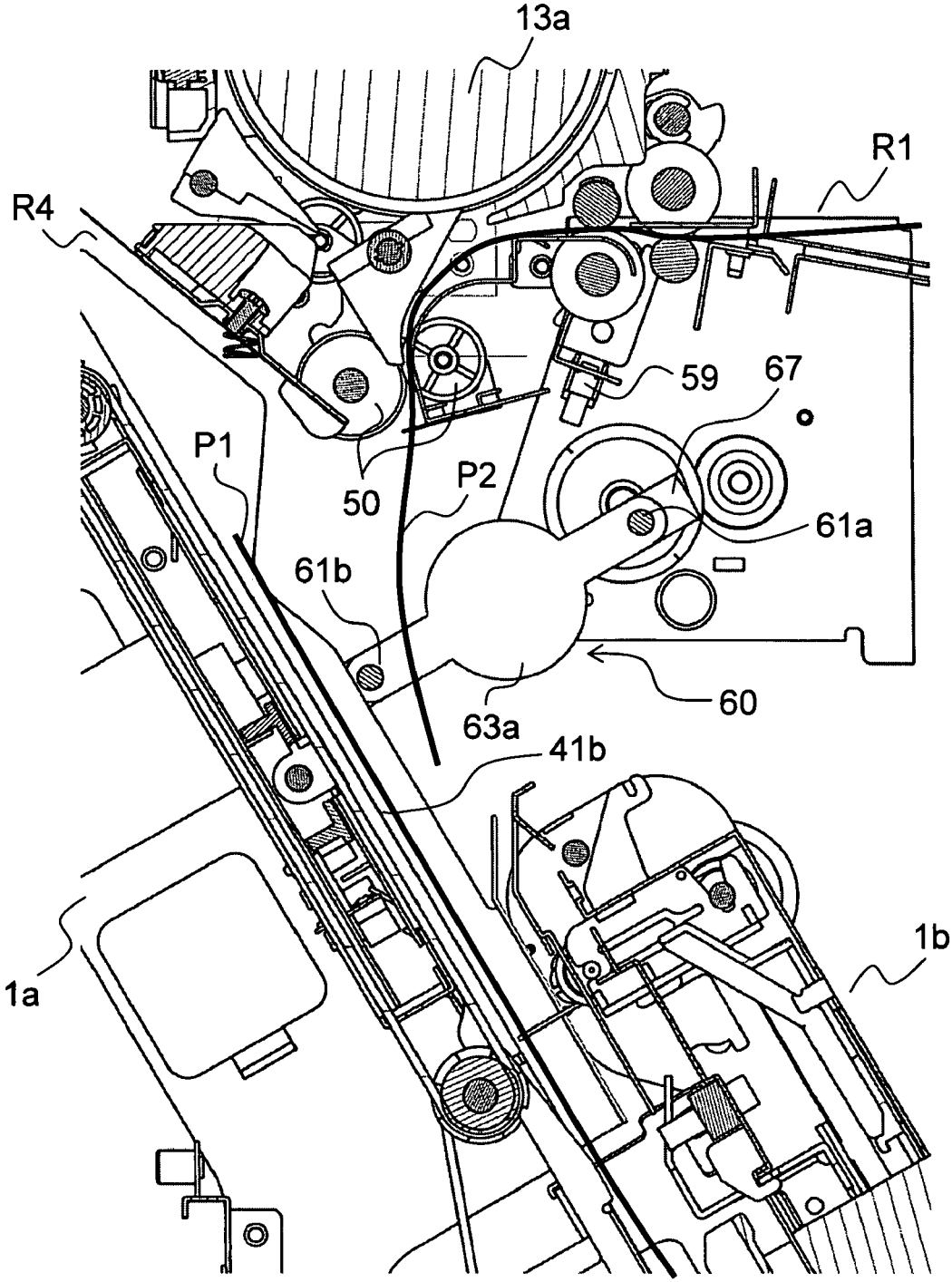
FIG. 7 is a partial sectional view of a part of the post-processing apparatus of the present invention around the paper pressing unit (a state in which the first sheet of paper P1 has been conveyed, and the second sheet of paper P2 starts being conveyed)

When the first sheet of paper P1 is detected by the paper detecting sensor 20, the paper pressing unit 60 starts rotating with predetermined timing and at predetermined speed in a direction (in FIG. 6, in a clockwise direction) opposite to the direction in which a sheet of paper is conveyed. Meanwhile, the sheet of paper P1 passes through the pair of conveying rollers 50, then passes between the paper pressing portions 61*a* and 61*b*, and is then conveyed to the paper receiving plate 41*b*. After the rear end of the sheet of paper P1 comes free from the pair of conveying rollers 50, and the sheet of paper P1 is placed on the paper receiving plate 41*b* with the leading edge thereof being supported by the paper raising/lowering member 9, the paper pressing unit 60 rotates a half turn from a state shown in FIG. 6, as shown in FIG. 7. As a result, the paper pressing portion 61*b* is moved to the paper pressing position, thereby preventing the rear end of the sheet of paper P1 from floating.

Following this, the second sheet of paper P2 passes between the paper pressing portions 61*a* and 61*b* and then starts being conveyed to the paper receiving plate 41*b*. Since the rear end of the sheet of paper P1 is pressed by the paper pressing portion 61*b*, there is no possibility that the leading edge of the sheet of paper P2 collides with the rear edge of the sheet of paper P1 or reaches under the sheet of paper P1.

Figure 8:
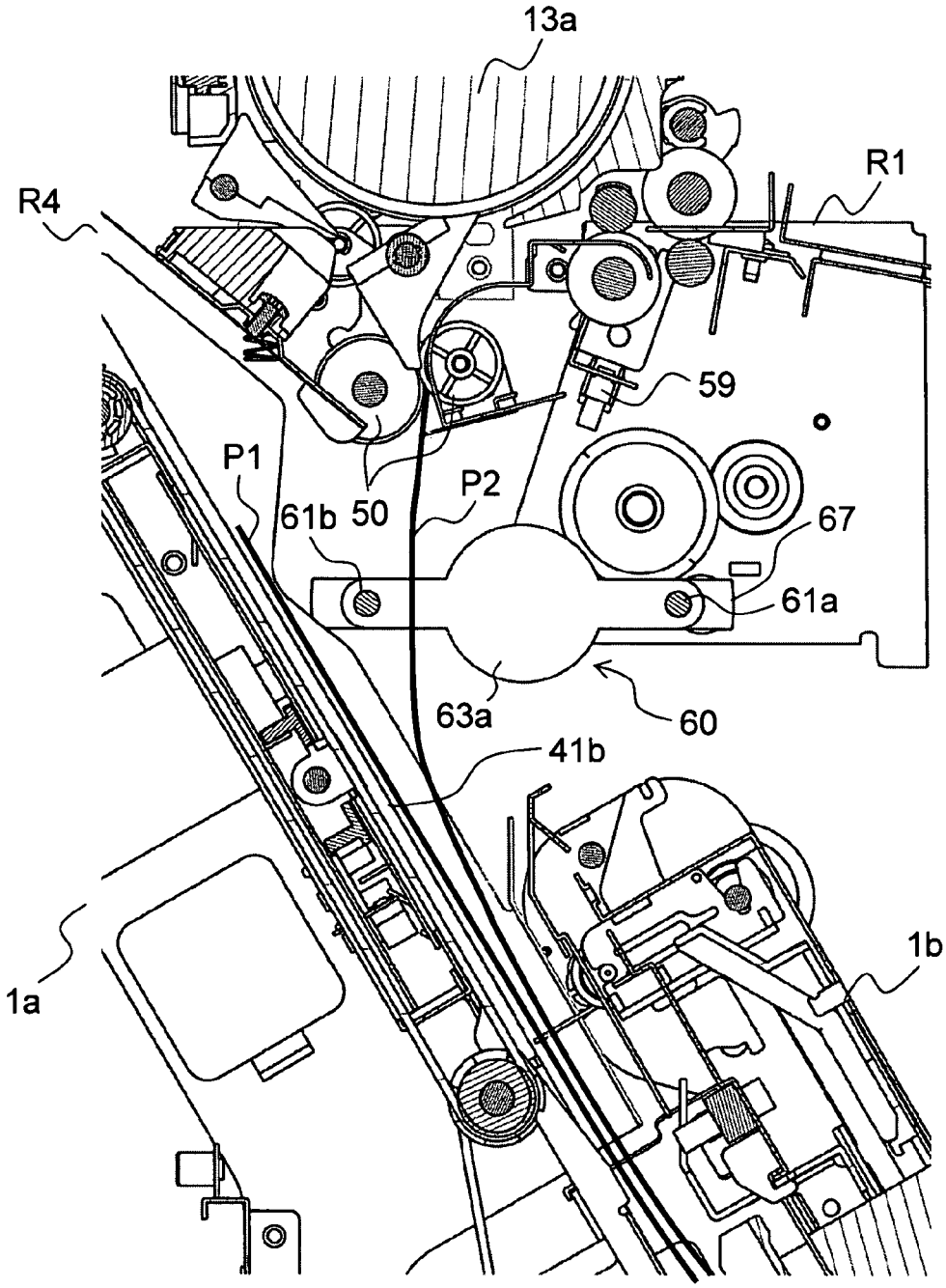
FIG. 8 is a partial sectional view of a part of the post-processing apparatus of the present invention around the paper pressing unit (a state in which most of the second sheet of paper P2 has been conveyed to the paper receiving surface)

As the sheet of paper P2 is conveyed to the paper receiving plate 41*b*, the paper pressing unit 60 continues rotating in a clockwise direction, and the paper pressing portion 61*b* moves increasingly away from the sheet of paper P1. As shown in FIG. 8, since most of the second sheet of paper P2 has already been conveyed to the paper receiving plate 41*b*, even when the rear end of the sheet of paper P1 floats, the sheet of paper P2 does not collide with the sheet of paper P1 or reach under the sheet of paper P1.

Figure 9:
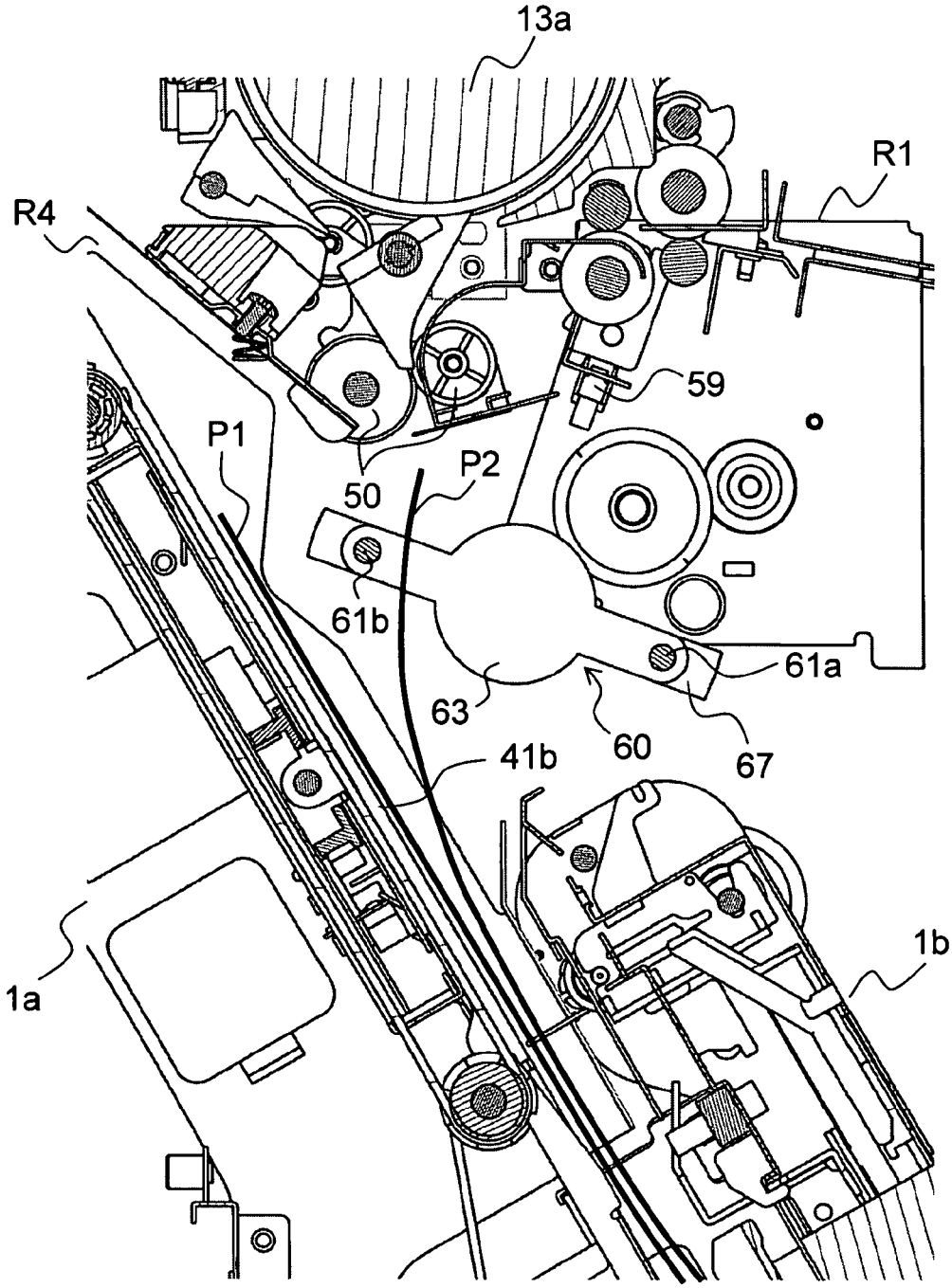
FIG. 9 is a partial sectional view of a part of the post-processing apparatus of the present invention around the paper pressing unit (a state in which the second sheet of paper P2 is separated from the conveying rollers)
Figure 10:
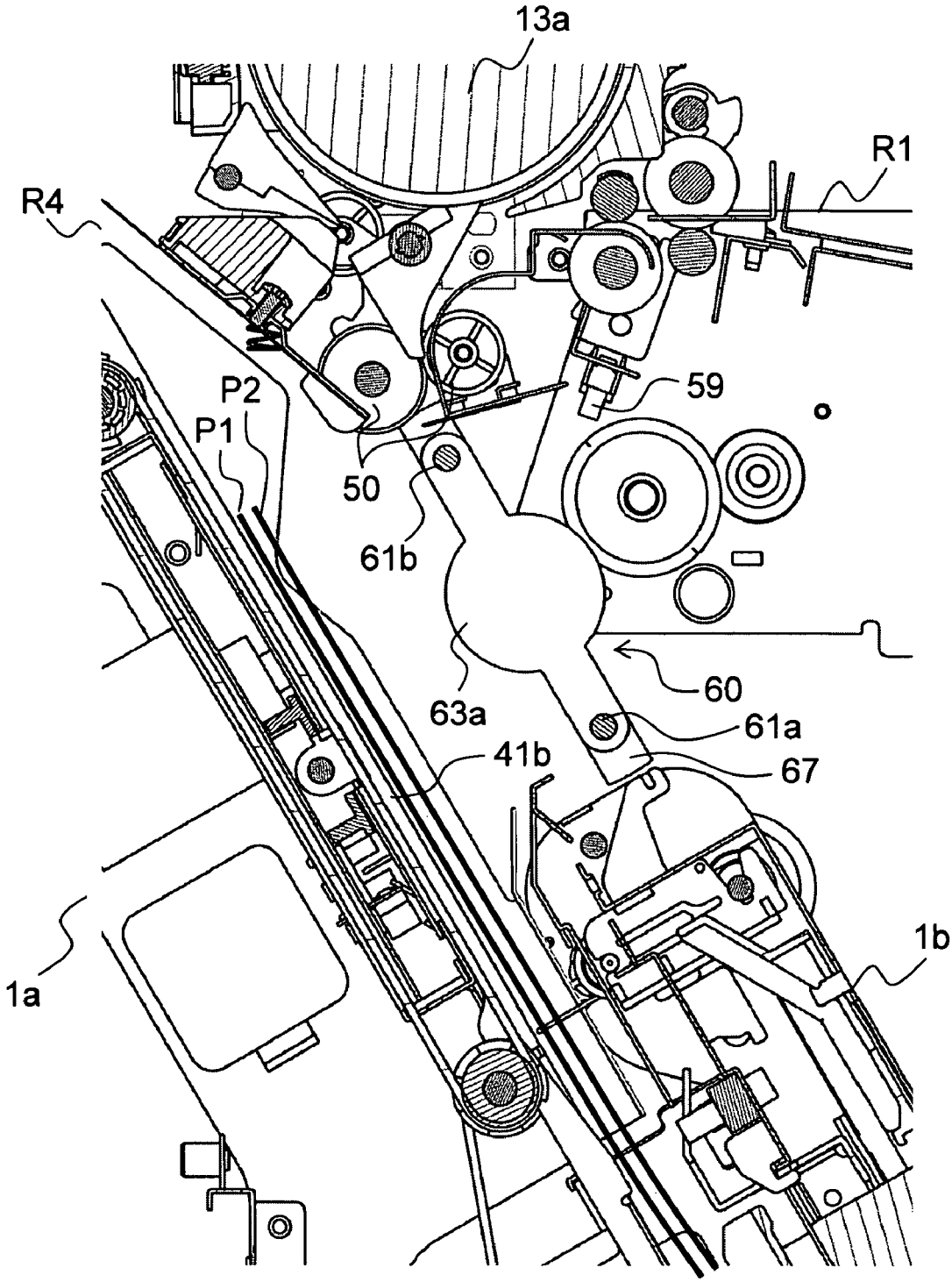
FIG. 10 is a partial sectional view of a part of the post-processing apparatus of the present invention around the paper pressing unit (a state in which the second sheet of paper P2 has been conveyed)
Figure 11:
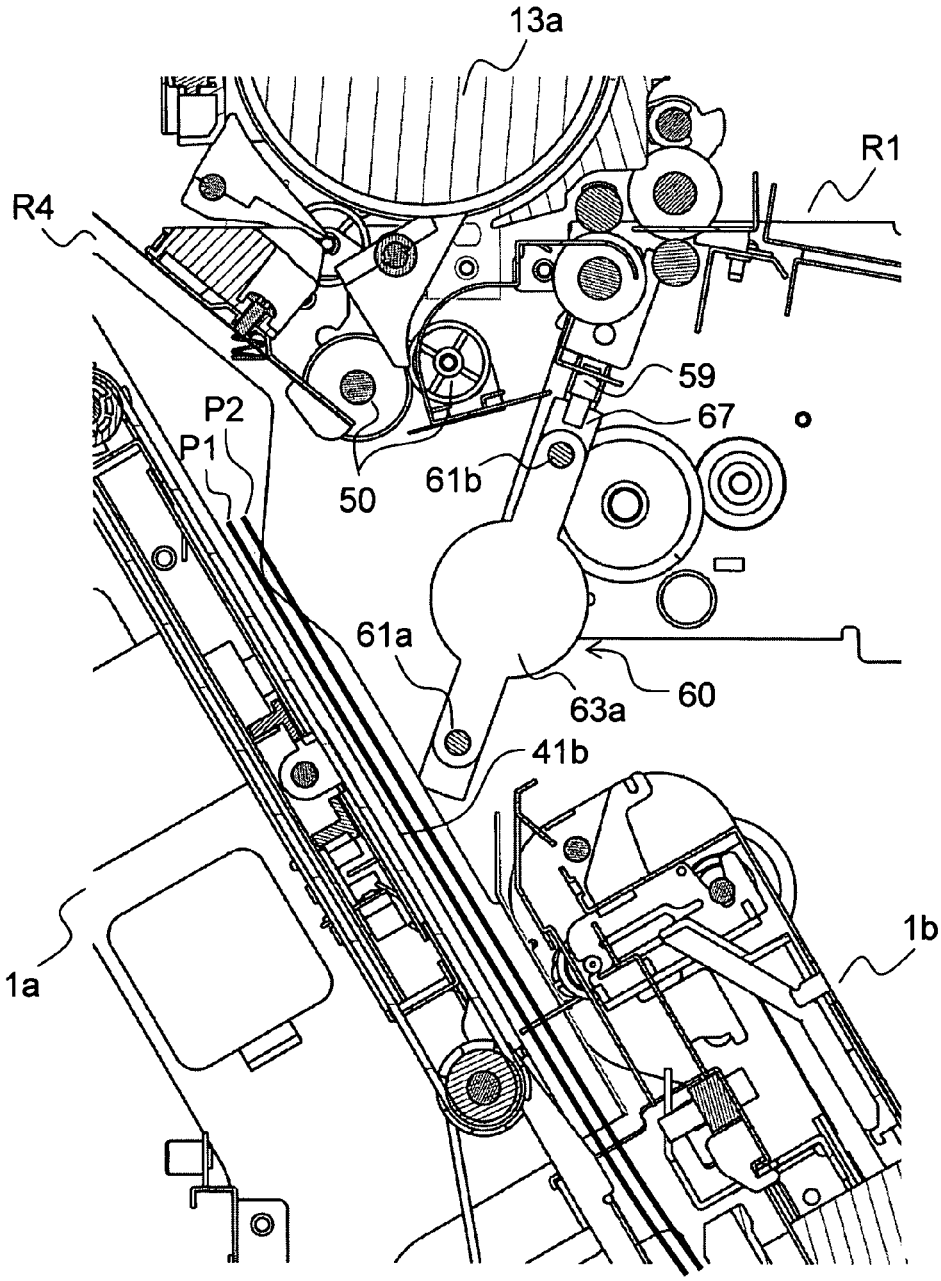
FIG. 11 is a partial sectional view of a part of the post-processing apparatus of the present invention around the paper pressing unit (a state in which the paper pressing portion is moving to a paper pressing position)

Then, as shown in FIG. 9, the rear end of the sheet of paper P2 comes free from the pair of conveying rollers 50 and falls to the paper receiving plate 41*b*. As a result, as shown in FIG. 10, the sheet of paper P2 is placed on the sheet of paper P1 with the leading edge thereof being supported by the paper raising/lowering member 9. In the meantime, the paper pressing unit 60 keeps rotating, and the connecting member 63*a* becomes nearly horizontal to the paper receiving plate 41*b*. As shown in FIG. 11, the paper pressing portion 61*a* comes close to the paper receiving plate 41*b* this time, and the paper pressing portion 61*a* is disposed in the paper pressing position, thereby preventing the rear end of the sheet of paper P2 from floating. Likewise, the third and subsequent sheets of paper are sequentially stacked on top of another on the paper receiving plate 41*b*, and the rear ends thereof are pressed by turns by the paper pressing portions 61*a* and 61*b*.

With this structure, when a plurality of sheets of paper are stacked one on top of another on the processing tray 1 to form a stack of paper, the next sheet of paper is conveyed between the paper pressing portions 61*a* and 61*b* while the rear end of the sheet of paper that has already been placed on the paper receiving plate 41*b* is pressed by one of the paper pressing portions 61*a* and 61*b*. This makes it possible to reliably prevent the leading edge of the next sheet of paper from bumping into the rear edge of the sheet of paper that has already been placed on the paper receiving plate 41*b* and causing a paper jam, and prevent the leading edge of the next sheet of paper from reaching under the sheet of paper that has already been placed on the paper receiving plate 41*b* and causing an undesirable change in the sequence of the stacked sheets of paper.

Unlike the conventional example, the paper pressing unit 60 rotates in one direction instead of swinging back and forth. This helps prevent the bound of the paper pressing portion, ensuring smooth movement of the paper pressing portion. In addition, this makes it easier to control the driving of the unit driving motor 55. Furthermore, since two paper pressing portions 61*a* and 61*b* are used by turns and each of them is disposed in the paper pressing position once in one turn of the paper pressing unit 60, it is possible to dispose the paper pressing portion in the pressing position twice in one turn of the paper pressing unit 60. As a result, the post-processing apparatus can be used with a fast-speed image forming apparatus, enhancing post-processing efficiency.

Incidentally, after the stack of paper placed on the paper receiving plate 41*b* is stapled and is then conveyed to the general-purpose tray 15 or to the folding portion 16, a sheet of paper that is made to wait on the ring-shaped conveying path R2 (see FIG. 1) is conveyed through the pair of conveying rollers 50 along with a sheet of paper conveyed over the entrance-side conveying path R1. Also in this case, these sheets of paper are placed on the paper receiving plate 41*b* in the same manner as described above, and the rear ends thereof are prevented from floating by the rotation of the paper pressing unit 60.

The time between the point at which a sheet of paper is detected by the paper detecting sensor 20 and the point at which the sheet of paper is placed on the paper receiving plate 41*b* varies depending on the dimension of a sheet of paper to be transported into the post-processing apparatus 100, the dimension in the direction in which the sheet of paper is conveyed (the length of the sheet of paper). Thus, it is necessary to change the timing with which each of the paper pressing portions 61*a* and 61*b* arrives at the paper pressing position by changing the rotational speed of the paper pressing unit 60 depending on the length of the sheet of paper. This can be achieved, for example, as follows. Different lengths of transportable sheet of paper and corresponding rotational speeds of the paper pressing unit 60 are previously stored in the ROM 71 or the RAM 73 (see FIG. 5) in the form of a table. Depending on the paper size information inputted from the image forming apparatus 101 to the control portion 70, an appropriate rotational speed is read from the ROM 71 or the RAM 73, such that the unit driving motor 55 is driven accordingly.

Alternatively, depending on the time a sheet of paper takes to be placed on the paper receiving plate 41*b*, the paper pressing unit 60 may be controlled to rotate one turn at different rotational speeds. In this case, for example, if the length of a sheet of paper is relatively short, the rotational speed of the paper pressing unit 60 is increased to a given level immediately before the paper pressing portion 61*a* or 61*b* arrives at the paper pressing position. On the other hand, if the length of a sheet of paper is relatively long, the rotational speed of the paper pressing unit 60 is reduced to a given level until just before the paper pressing portion 61*a* or 61*b* arrives at the paper pressing position, or the paper pressing unit 60 is driven intermittently, such that the rotation thereof is suspended and resumed.

Figure 12:
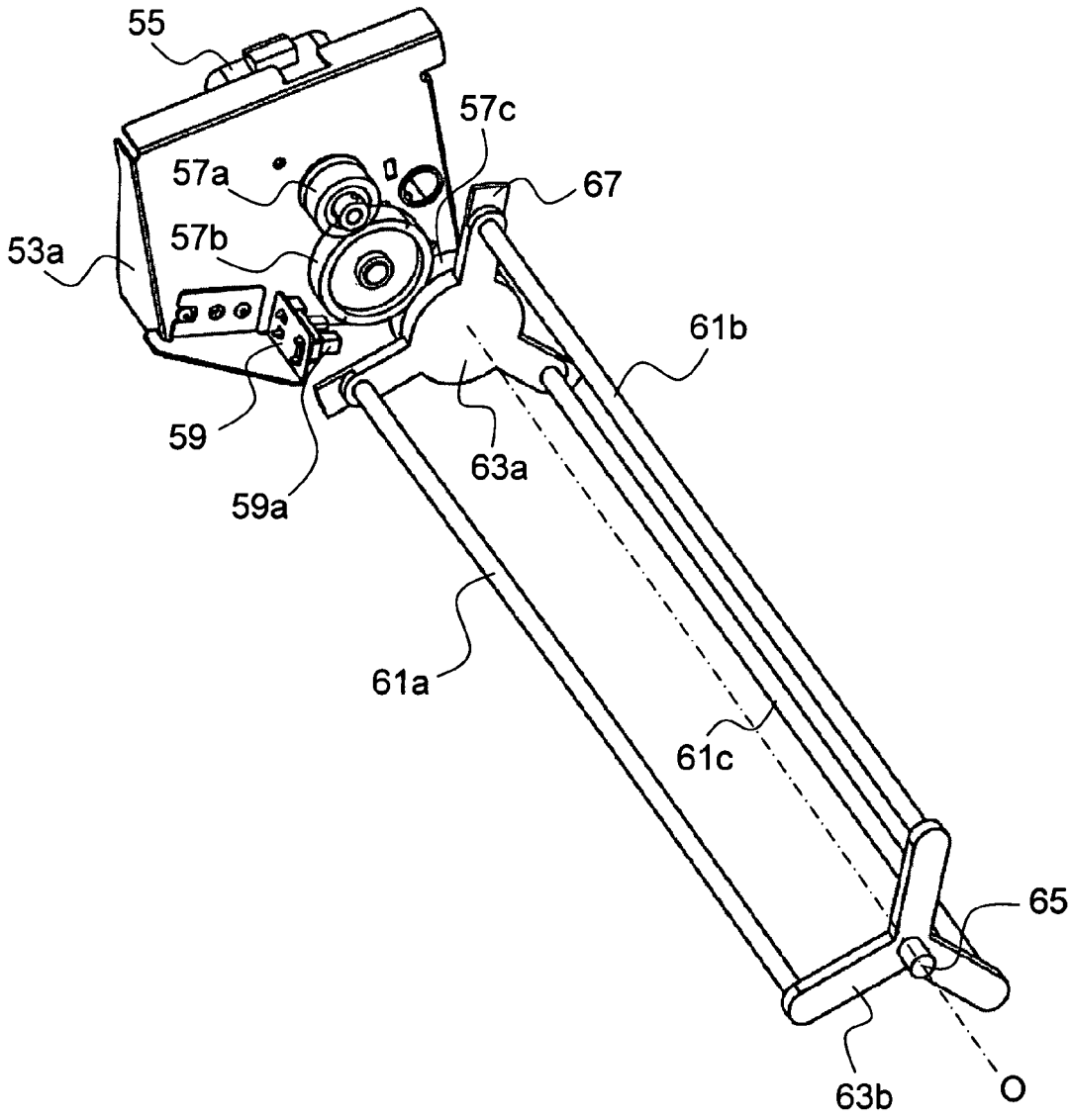
FIG. 12 is a perspective view showing another example of the structure of the paper pressing unit.
Figure 13:
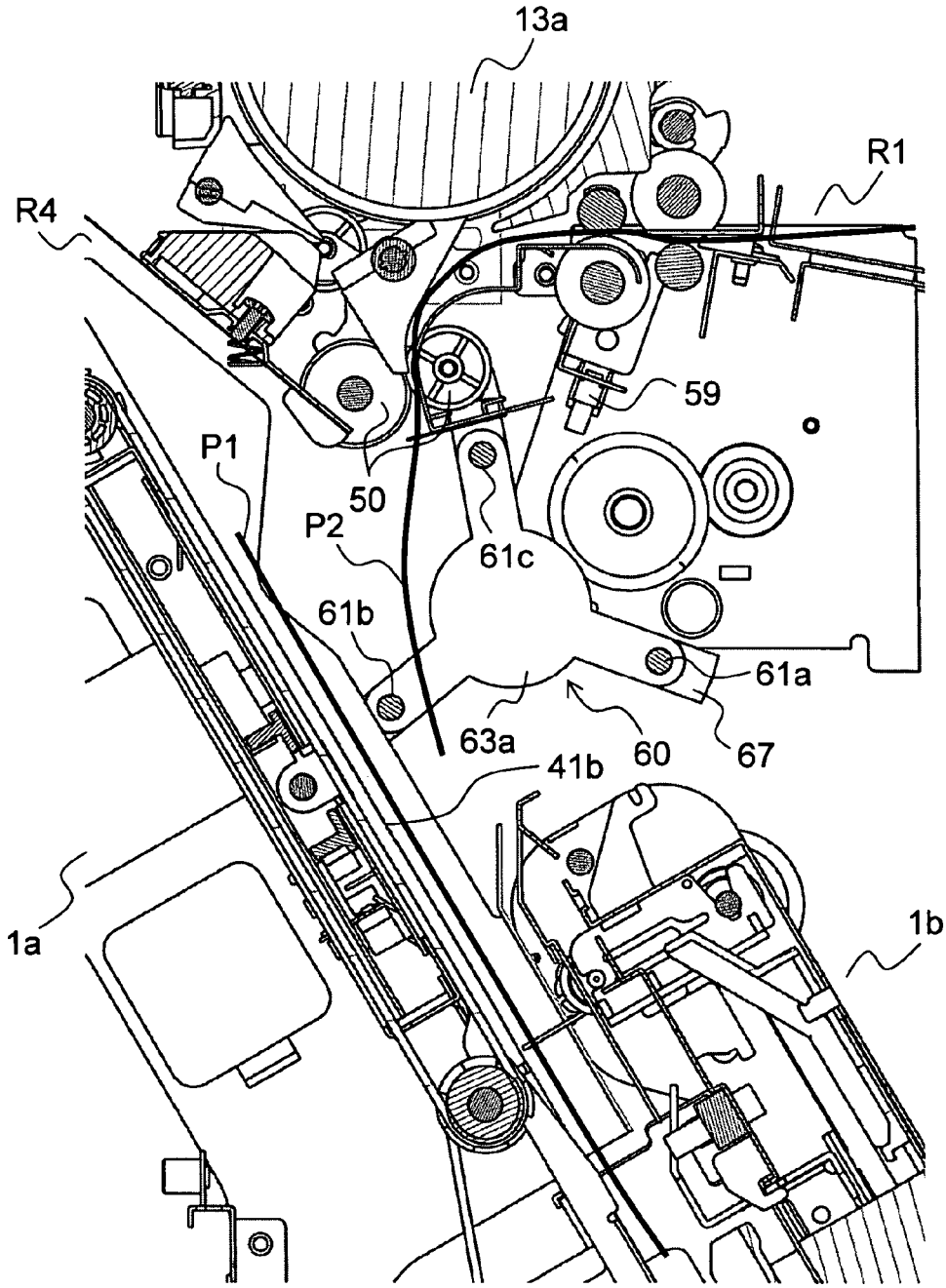
FIG. 13 is a partial sectional view of the post-processing apparatus incorporating the paper pressing unit shown in FIG. 12 (a state in which the first sheet of paper P1 has been conveyed, and the second sheet of paper P2 starts being conveyed)

FIG. 12 is a perspective view showing another example of the structure of the paper pressing unit, and FIG. 13 is a partial sectional view of the post-processing apparatus incorporating the paper pressing unit shown in FIG. 12. It is to be noted that such members as are found also in FIGS. 3 and 6 are identified with common reference numerals and their detailed descriptions will be omitted. In this example, three paper pressing portions 61*a*, 61*b*, and 61*c* are connected to the connecting members 63*a* and 63*b* so as to be equidistant from the rotational shafts 65. That is, the paper pressing portions 61*a* to 61*c* are disposed in such a way that a surface of a circular cylinder whose cylindrical axis corresponds to a line O passing through the rotational shafts 65 is divided thereby into equal parts (into three equal parts).

With this structure, as compared with the structure shown in FIG. 3, the space between the paper pressing portions 61*a* to 61*c* is reduced, and each of the paper pressing portions 61*a* to 61*c* is disposed once in the paper pressing position in one turn of the paper pressing unit 60. As a result, it is possible to dispose the paper pressing portion in the pressing position three times in one turn of the paper pressing unit 60. This makes it possible to further increase a processing speed without increasing the rotational speed of the unit driving motor 55.

The invention may be practiced in any other manner than specifically described above, with any modification or variation made within the spirit of the invention. For example, the embodiment described above deals with a structure in which two or three paper pressing portions are provided. However, it is also possible to provide four or more paper pressing portions. Incidentally, in a case where a plurality of conveying paths R5 are provided one for each paper size, advisably, paper pressing units 60 are provided one for each of the conveying paths R5 in the vicinity thereof.

The embodiment described above deals with a case in which the stapler 5 provided in the processing tray 1 serves as a stapler that can staple a stack of paper at the end and in the middle thereof. Alternatively, the invention is applicable also to, for example, a structure in which a stapler exclusively for stapling a stack of paper in the middle is provided in the folding portion 16, and a plurality of sheets of paper are directly conveyed into the folding portion 16 without passing through the processing tray 1. With this structure, it is possible to dispose the paper pressing unit 60 near the downstream side of the conveying path R7.

The present invention is directed to a post-processing apparatus provided with: a processing tray on which a plurality of sheets of paper are placed; a pair of conveying rollers provided on the upstream side of the processing tray along a conveying direction thereof, the pair of conveying rollers conveying a sheet of paper to the processing tray; and a paper pressing member disposed near the upstream end of the processing tray so as to face that end, the paper pressing member pressing the rear end of the sheet of paper placed on the processing tray against the processing tray. The paper pressing member is composed of: a paper pressing unit having rotational shafts each extending in a direction that is parallel to a paper receiving surface of the processing tray and is orthogonal to the direction in which the sheet of paper is conveyed and a plurality of paper pressing portions disposed parallel to the rotational shafts in such a way that a surface of a circular cylinder whose cylindrical axis corresponds to a line passing through the rotational shafts is divided thereby into equal parts; and a unit driving motor driving the paper pressing unit to rotate. The paper pressing member sequentially presses the rear end of each sheet of paper conveyed to the processing tray by rotating the paper pressing unit in a direction opposite to the direction in which the sheet of paper is conveyed.

As a result, the present invention helps realize post-processing apparatuses that can achieve smooth operation of the paper pressing unit and easily control the driving of the unit driving motor. In particular, such post-processing apparatuses eliminate the need to reduce the printing speed even when they are connected to image forming apparatuses that can perform printing at high speed. This helps enhance post-processing efficiency.

Furthermore, since the next sheet of paper is conveyed to the processing tray through a space between the paper pressing portions and the rotational shafts while the rear end of the sheet of paper that has already been placed on the processing tray is pressed by one of the paper pressing portions, the post-processing apparatuses can reliably prevent sheets of paper from being unsuccessfully stacked on the processing tray. For example, the post-processing apparatuses can prevent the leading edge of the next sheet of paper from bumping into the rear edge of the sheet of paper that has already been placed on the processing tray and causing a paper jam, and prevent the leading edge of the next sheet of paper from reaching under the sheet of paper that has already been placed on the processing tray and causing an undesirable change in the sequence of the stacked sheets of paper. Moreover, by using the paper pressing unit that is provided with rotational shafts at both ends thereof and is formed as a frame-shaped member, the post-processing apparatuses can convey the sheet of paper more smoothly and suffers less from paper jam or the like.

In addition, since there is provided a controller for changing the rotational speed of the unit driving motor depending on the length of the sheet of paper in the direction in which it is conveyed, the post-processing apparatuses can reliably prevent the rear end of the sheet of paper from floating irrespective of the length thereof.

What is claimed is:

1. A post-processing apparatus comprising:

a processing tray on which a plurality of sheets of paper are placed;

a pair of conveying rollers provided on an upstream side of the processing tray along a conveying direction thereof, the pair of conveying rollers conveying a sheet of paper to the processing tray; and a paper pressing member disposed near an upstream end of the processing tray so as to face the upstream end of the processing tray, wherein the paper pressing member comprises:

a paper pressing unit having rotational shafts each extending in a direction that is parallel to a paper receiving surface of the processing tray and is orthogonal to a direction in which a sheet of paper is conveyed, and a plurality of paper pressing portions each being disposed parallel to the rotational shafts and having a surface at which the paper pressing portion is brought into contact with the sheet of paper, the surface being located on a surface of a circular cylinder whose cylindrical axis corresponds to a line passing through the rotational shafts; and a unit driving motor driving the paper pressing unit to rotate, wherein the paper pressing unit has a space between one pressing a rear end of the sheet of paper and the other of the plurality of paper pressing portions, and a next sheet of paper passing through the pair of conveying rollers is conveyed to the processing tray through the space while the rear end of the sheet of paper that has already been placed on the processing tray is pressed by the one of the plurality of paper pressing portions.

2. The post-processing apparatus of claim 1, wherein a length of the paper pressing portion is longer than a maximum width of paper to be conveyed to the processing tray.

3. The post-processing apparatus of claim 1, wherein the paper pressing portions are individually brought into contact with the sheet of paper at the surfaces thereof; the surfaces being located on the surface of the circular cylinder whose cylindrical axis corresponds to the line passing through the rotational shafts in such a way as to divide the surface of the circular cylinder into equal parts.

4. The post-processing apparatus of claim 1, wherein the paper pressing portions each have at least a curved surface at which the paper pressing portion is brought into contact with the sheet of paper.

5. The post-processing apparatus of claim 1, wherein the paper pressing unit has a pair of connecting members disposed with a space left therebetween, the space being wider than the maximum width of paper to be conveyed to the processing tray, the pair of connecting members to which the paper pressing portions are each connected at both ends thereof, the rational shafts each protrude outward from a central part of a corresponding one of the connecting members.

6. A post-processing apparatus comprising:

a processing tray on which a plurality of sheets of paper are placed;

a pair of conveying rollers provided on an upstream side of the processing tray along a conveying direction thereof, the pair of conveying rollers conveying a sheet of paper to the processing tray; and a paper pressing member disposed near an upstream end of the processing tray so as to face the upstream end of the processing tray, wherein the paper pressing member comprises a paper pressing unit having rotational shafts each extending in a direction that is parallel to a paper receiving surface of the processing tray and is orthogonal to a direction in which a sheet of paper is conveyed, and a plurality of paper pressing portions each being disposed parallel to the rotational shafts and having a surface at which the paper pressing portion is brought into contact with the sheet of paper, the surface being located on a surface of a circular cylinder whose cylindrical axis corresponds to a line passing through the rotational shafts, wherein cylindrical members are provided around the paper pressing portions in such a way that the cylindrical members can rotate around the paper pressing portions, wherein a unit driving motor drives the paper pressing unit to rotate, and wherein the paper pressing member sequentially presses a rear end of each sheet of paper conveyed to the processing tray by rotating the paper pressing unit in a direction opposite to a direction in which the sheet of paper is conveyed.

7. The post-processing apparatus of claim 6, wherein the paper pressing portions are individually brought into contact with the sheet of paper at the surfaces thereof, the surfaces being located on the surface of the circular cylinder whose cylindrical axis corresponds to the line passing through the rotational shafts in such a way as to divide the surface of the circular cylinder into two equal parts.

8. A post-processing apparatus comprising:

a processing tray on which a plurality of sheets of paper are placed;

a pair of conveying rollers provided on an upstream side of the processing tray along a conveying direction thereof, the pair of conveying rollers conveying a sheet of paper to the processing tray; and a paper pressing member disposed near an upstream end of the processing tray so as to face the upstream end of the processing tray, wherein the paper pressing member comprises:

a paper pressing unit having rotational shafts each extending in a direction that is parallel to a paper receiving surface of the processing tray and is orthogonal to a direction in which a sheet of paper is conveyed, and a plurality of paper pressing portions each being disposed parallel to the rotational shafts and having a surface at which the paper pressing portion is brought into contact with the sheet of paper, the surface being located on a surface of a circular cylinder whose cylindrical axis corresponds to a line passing through the rotational shafts, wherein cylindrical members are provided around the paper pressing portions in such a way that the cylindrical members can rotate around the paper pressing portions;

wherein a unit driving motor driving the paper pressing unit to rotate, and wherein the paper pressing member sequentially presses a rear end of each sheet of paper conveyed to the processing tray by rotating the paper pressing unit in a direction opposite to a direction in which the sheet of paper is conveyed, a paper detecting sensor that detects a sheet of paper transported into the post-processing apparatus;

a pressing portion detecting sensor that detects positions of the paper pressing portions; and a controller that controls rotation of the paper pressing unit based on the detection results of the paper detecting sensor and the pressing portion detecting sensor.

9. The post-processing apparatus of claim 8, wherein the controller changes a rotational speed of the unit driving motor depending on a length of a sheet of paper in a direction in which the sheet of paper is conveyed to the processing tray.

10. The post-processing apparatus of claim 8, wherein the controller controls the paper pressing unit to rotate one turn at different rotational speeds depending on a time the sheet of paper takes to be placed on the processing tray.

11. An image forming system comprising:

the post-processing apparatus of claim 1; and an image forming apparatus from which a sheet of paper having an image formed thereon is transported into the post-processing apparatus.

* * * * *